US006247900B1

(12) United States Patent
Archibald et al.

(10) Patent No.: US 6,247,900 B1
(45) Date of Patent: Jun. 19, 2001

(54) STROKE SENSING APPARATUS FOR A VARIABLE DISPLACEMENT COMPRESSOR

(75) Inventors: Charles Andrew Archibald; Thomas Martin Urbank, both of Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/347,730

(22) Filed: Jul. 6, 1999

(51) Int. Cl.[7] ..... F04B 1/26

(52) U.S. Cl. ..... 417/222.1; 417/63; 62/228.5

(58) Field of Search ..... 62/160, 228.1, 62/133, 175, 228.5, 209, 222.1; 417/222.2, 295, 63; 318/687; 310/135

(56) References Cited

U.S. PATENT DOCUMENTS

| | | | | |
|---|---|---|---|---|
| 4,345,442 | * | 8/1982 | Dorman | 62/160 |
| 4,353,220 | * | 10/1982 | Curwen et al. | 62/228.1 |
| 4,487,029 | * | 12/1984 | Hidaka et al. | 62/133 |
| 4,506,517 | * | 3/1985 | Pandzik | 62/175 |
| 4,730,986 | * | 3/1988 | Kayukawa et al. | 417/222 |
| 4,737,079 | | 4/1988 | Kurosawa et al. | 417/222 |
| 4,744,732 | * | 5/1988 | Nakajima et al. | 417/295 |
| 4,772,838 | * | 9/1988 | Maresca | 318/687 |
| 4,783,609 | * | 11/1988 | Sugiyama et al. | 310/168 |
| 4,822,252 | | 4/1989 | Ishikawa et al. | 417/222 |
| 4,867,648 | | 9/1989 | Murayama | 417/222 |
| 4,961,690 | | 10/1990 | Simoyama et al. | 417/222 |
| 4,966,529 | | 10/1990 | Ide | 417/218 |
| 5,022,826 | | 6/1991 | Matsuda et al. | 417/63 |
| 5,032,772 | * | 7/1991 | Gully et al. | 318/135 |
| 5,046,927 | | 9/1991 | Ohno et al. | 417/222 |
| 5,100,301 | | 3/1992 | Hidaka et al. | 417/222 |
| 5,189,886 | * | 3/1993 | Terauchi | 62/228.5 |
| 5,284,026 | * | 2/1994 | Powell | 62/209 |
| 5,407,328 | | 4/1995 | Kimura et al. | 417/222.1 |
| 5,749,710 | * | 5/1998 | Kimura et al. | 417/63 |

* cited by examiner

*Primary Examiner*—Teresa Walberg
*Assistant Examiner*—L Fastovsky
(74) *Attorney, Agent, or Firm*—Patrick M. Griffin

(57) ABSTRACT

An accurate and low cost sensing apparatus for a swash or wobble plate compressor that requires no modifications in compressor design or operation, and which provides a repeatable and accurate measure of compressor speed and stroke. The apparatus includes a sensor module and a stroke sensing circuit. The compressor has an outer housing formed of aluminum or other non-magnetic material, as is customary in automotive air conditioning systems. The sensor module includes a magnetic field responsive sensor such as a Hall Effect or magneto-resistive (MR) sensor, and is attached to the periphery of the housing in proximity to a reciprocating ferrous element such as a bushing shoe on the swash or wobble plate assembly. The sensor produces a quasi-sinusoidal output voltage signal having a frequency proportional to compressor speed, and the stroke sensing circuit determines the compressor stroke by band-pass filtering, amplifying, and peak detecting the signal. The output of the stroke sensing circuit is substantially insensitive to noise, and the relationship between it and the compressor stroke is substantially linear, resulting in a reliable, accurate and inexpensive sensing apparatus.

8 Claims, 2 Drawing Sheets

STROKE SENSING APPARATUS FOR A VARIABLE DISPLACEMENT COMPRESSOR

TECHNICAL FIELD

This invention relates to motor vehicle air conditioning systems including a variable displacement refrigerant compressor mechanically coupled to a rotary shaft of the vehicle engine, and more particularly to a non-intrusive sensing apparatus for determining operating parameters of the compressor.

BACKGROUND OF THE INVENTION

Variable displacement refrigerant compressors have been utilized in automotive air conditioning systems, with the displacement regulated in accordance with cooling demand via either a hydraulic control valve or solenoid control valve. In a typical arrangement, the compressor includes one or more pistons coupled to a tiltable wobble plate or swash plate, and the control valve adjusts a differential pressure acting on a wobble plate control mechanism to vary the wobble plate tilt angle, and hence the compressor displacement or stroke.

Various sensing devices have been proposed for determining the compressor speed and stroke, either for control or diagnostic purposes. In general, the sensing devices include a magnet mounted on a reciprocating element of the compressor, and a magnetic sensor mounted in or on the compressor housing in proximity to the reciprocating magnet. As the magnet reciprocates, the sensor develops a pulse or quasi-sinusoidal voltage waveform. The frequency of the waveform is typically independent of compressor stroke, and can be used as a measure of compressor speed, whereas the duty cycle of the waveform varies with the angle of the wobble or swash plate, and can be used as a measure of compressor stroke. Generally speaking, these devices are problematic because (1) they require changes in the mechanical design of the compressor, (2) the stroke measurement is non-linearly related to the actual stroke, and (3) the duty cycle measurements are subject to significant variation due to noise in the sensor output signal. As a result, a sensing system based on the known techniques is both costly and unreliable.

SUMMARY OF THE INVENTION

The present invention is directed to an improved low cost sensing apparatus for a swash or wobble plate compressor that requires no modifications in compressor design or operation, and which provides a repeatable and accurate measure of compressor stroke.

The apparatus of the invention comprises just two elements: a sensor module and a stroke sensing circuit. The compressor has an outer housing formed of aluminum or other non-magnetic material, as is customary in automotive air conditioning systems, and the sensor module includes a magnetic field responsive sensor such as a Hall Effect or magneto-resistive (MR) sensor. The sensor module is attached to the periphery of the housing in proximity to a reciprocating ferrous element such as a bushing shoe on the periphery of the swash or wobble plate assembly. Thus, no changes in the mechanical design of the compressor are required. The sensor produces a quasi-sinusoidal output voltage signal having a frequency proportional to compressor speed, and a stroke sensing circuit determines the compressor stroke by band pass filtering, amplifying, and peak detecting the signal. Additionally, the signal can be compensated for sensor non-linearities, if required. The output of the stroke sensing circuit is substantially insensitive to noise, and the relationship between it and the compressor stroke is substantially linear, resulting in a reliable, accurate and inexpensive sensing apparatus.

DESCRIPTION OF THE PREFERRED EMBODIMENT

Figure 1:
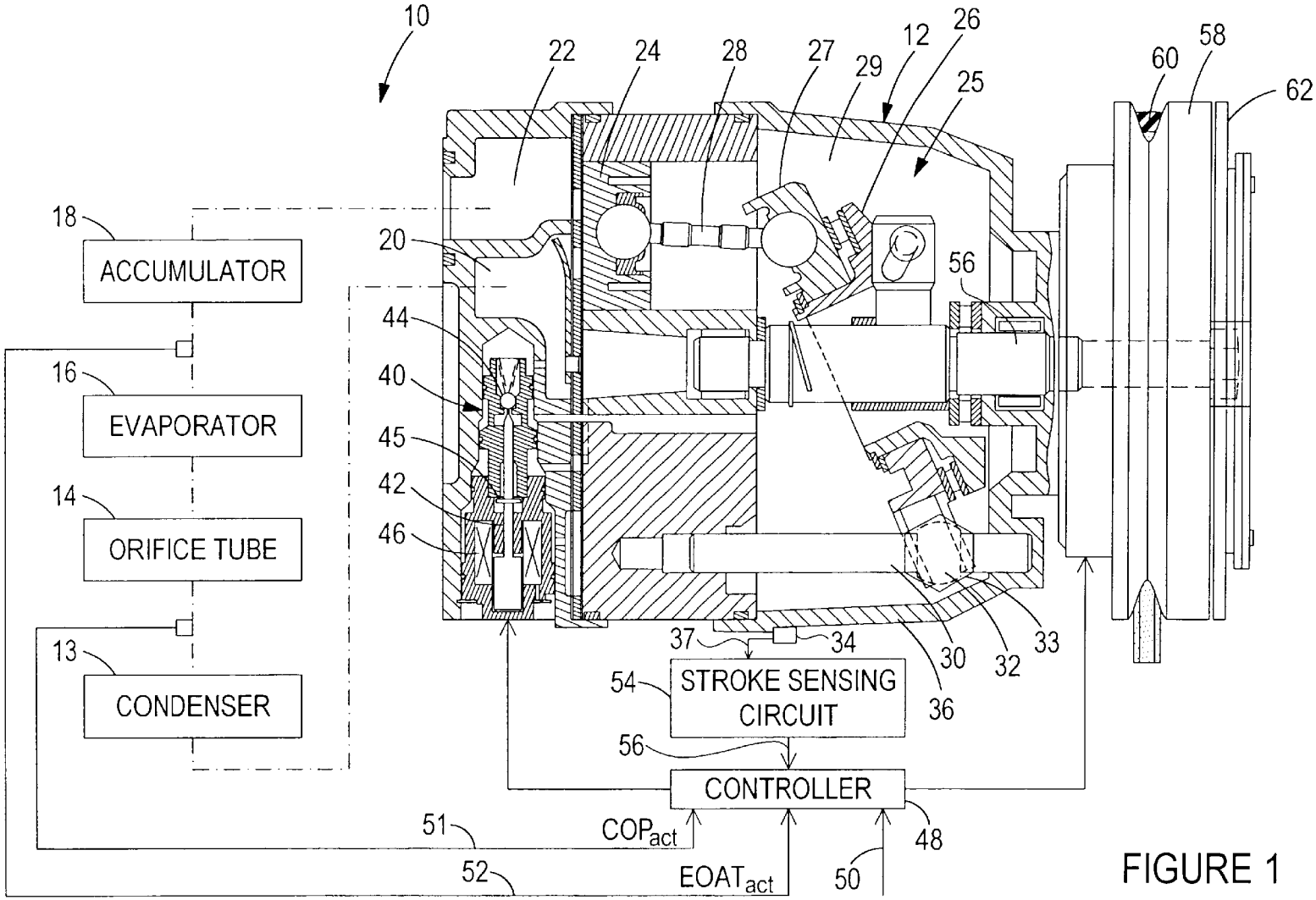
FIG. 1 is a schematic diagram of an automotive air conditioning system including an electronically controlled variable displacement compressor, and a sensor module and stroke sensing circuit according to this invention.

Referring to the drawings, and particularly to FIG. 1, the reference numeral 10 generally designates an automotive air conditioning (AC) system including an electronically controlled multi-cylinder variable displacement refrigerant compressor 12 of the variable angle wobble plate type. The other elements of the system 10 are conventional, and include condenser 13, orifice tube 14, evaporator 16 and accumulator 18 arranged in order between the compressor discharge cavity 20 and suction cavity 22.

A variable speed engine drive shaft (not shown) is coupled to a compressor pulley 58 via drive belt 60, and the pulley 58 is coupled to a compressor drive shaft 56 by an electromagnetic clutch 62. In certain applications, the clutch 62 may be eliminated, so long as another mechanism is provided for selectively de-coupling the compressor 12 from the remainder of the system 10. A number of pistons 24 (only one of which is shown in FIG. 1) are mounted in the compressor crankcase 29 so as to be reciprocally driven by the shaft 56 through a tiltable wobble plate mechanism, generally designated by the reference numeral 25. The shaft 56 rotatably drives a first tiltable plate 26, and a second tiltable plate 27 that tilts with the first plate 26, but which does not rotate, is coupled to the pistons 24 by the ball-joint connecting rods 28. The rotary position of the second plate 27 is maintained by a number of guide rods 30 (only one of which is shown in FIG. 1), each of which is coupled to the plate 27 by a brass bushing 32 (shown in phantom) which rides on a pair of ferrous shoes 33, only one of which is shown in FIG. 1. Thus, the brass bushings 32 and ferrous shoes 33 linearly reciprocate on the guide rods 30, with the extent of their displacement being determined by the operating angle of the tiltable plates 26, 27. A magnetic proximity sensor module 34 mounted on an exterior surface of the crankcase housing 36 in line with a guide rod 30 senses the reciprocation of the steel shoes 33, and provides an electrical output signal in accordance therewith to a stroke sensing circuit 54 on line 37. A similar arrangement is used in a swash-plate type compressor, except that the shoes 33 are captured in trailing portions of the pistons 24, and the sensor module 34 is located accordingly.

The stroke of the pistons 24, and hence the displacement of the compressor 12, is determined by the operating angle of the tiltable plates 26, 27. In the illustrated embodiment, the operating angle is regulated by pulse-width-modulating (PWM) a solenoid actuated control valve 40 to control the pressure in crankcase 29. The control valve 40 includes two valves mechanically coupled to an armature 42: a normally closed ball poppet valve 44 coupling the crankcase 29 to the compressor discharge cavity 20 and a normally open flat poppet valve 45 coupling the crankcase 29 to the compressor suction cavity 22. When the solenoid coil 46 is de-energized, gas pressure in the crankcase 29 bleeds off into suction cavity 22 through poppet valve 45; when coil 46 is energized, high pressure gas enters crankcase 29 from discharge cavity 20 through poppet valve 44. In general, increasing the PWM duty cycle (i.e., the on/off energization ratio of solenoid coil 46) increases the crankcase pressure to decrease the operating angle of the wobble plates 26, 27, and hence the compressor displacement, whereas decreasing the PWM duty cycle decreases the crankcase pressure, thereby increasing the operating angle of wobble plates 26, 27, and hence the compressor displacement.

The solenoid coil 46 and the compressor clutch 62 are both controlled by an electronic controller 48 in response to a number of inputs including an operator demand signal on line 50, and one or more system signals such as the condenser outlet pressure signal (COPact) on line 51 and the evaporator outlet air temperature signal (EOATact) on line 52. It will be understood that such signals are only exemplary. The controller 48 is additionally responsive to the output of stroke sensing circuit 54, which provides an indication of the compressor displacement, or stoke, on line 56. While the specific compressor control algorithm is not important to this invention, the development of an accurate and reliable stroke indication would enable a closed-loop control of stroke, for example.

Figure 2:
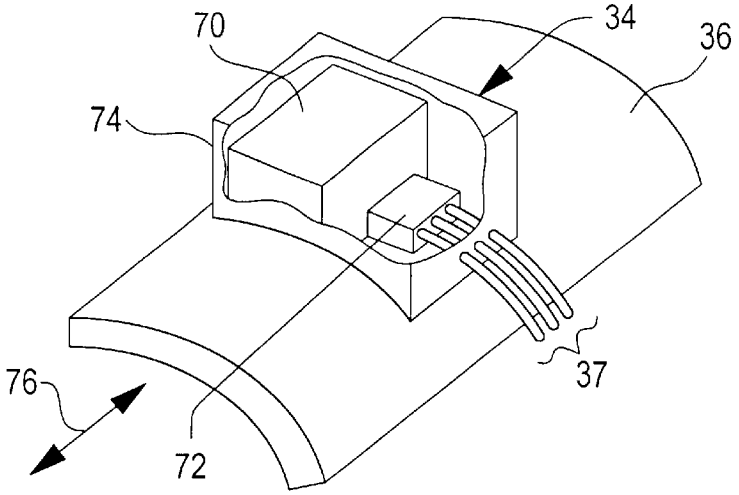
FIG. 2 depicts the sensor module of FIG. 1.

As indicated above, the sensor module 34 may comprise any electromagnetic proximity sensor such as a Hall-Effect or MR sensor. In either event, the sensor is positioned on the exterior periphery of crankcase housing 36 just opposite a guide rod 30, such that the distance between the sensor module 34 and the steel shoes 33 is at a minimum when the compressor 12 is operating at full stroke as shown in FIG. 1. In this way, the peak amplitude of the sensor output signal will be at a maximum value at full stroke, linearly decreasing to a minimum value as the compressor 12 is de-stroked. In the illustrated embodiment, the sensor module 34 comprises a permanent magnet 70 and a low noise Hall-Effect sensor 72 potted in a plastic housing 74 that is glued or strapped to the crankcase housing 36, as depicted in FIG. 2. The sensor housing 74 is positioned with a fixture (not shown) at the time of its installation so that the magnet 70 is in line with the reciprocating travel path of the bushing shoes 33, indicated by the arrow 76, and its magnetic poles are oriented so that the magnetic flux lines pass through the aluminum housing 36, the steel shoes 33, and back through the housing 36 adjacent the magnet 70. A portion of the return flux lines pass through the Hall Effect sensor 72, and the signal produced on lines 37 is a measure of the relative proximity of the bushing shoes 33 to the magnet 70. It is also possible to locate the magnet 70 directly atop the sensor 72, depending on the magnetic field strength and the saturation characteristics of the sensor 72.

Figure 3:
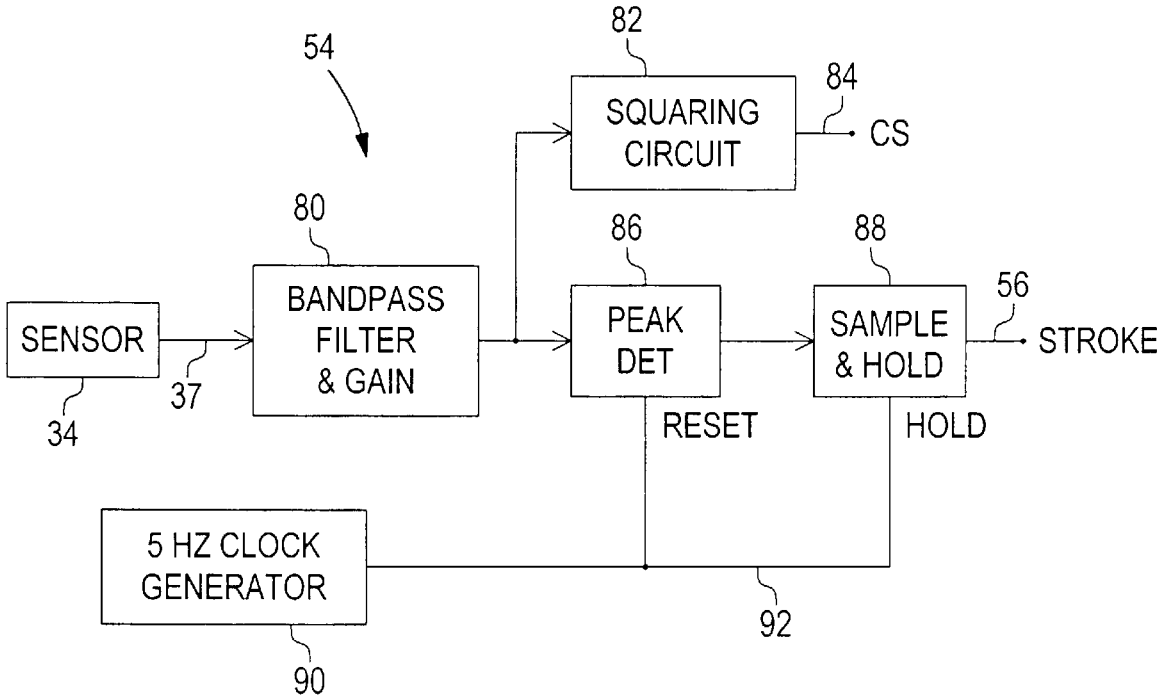
FIG. 3 is a block diagram of the stroke sensing circuit of FIG. 1.

In a preferred mechanization, the Hall Effect sensor may be an Allegro A3506LU, or equivalent, and the magnet may be a high strength rare earth magnet. Preferably, the strength of the magnet is maximized (within cost and package size constraints) so that the effect of stray magnetic flux from the electromagnetic clutch 62 does not significantly influence the signal developed on lines 37. In some applications it is possible to eliminate the magnet 70, and rely exclusively on the stray magnetic flux from the electromagnetic clutch 62, but this requires compensation for variations in the strength of the magnetic flux due to variation in the current supplied to the clutch 62. In clutch-less compressor designs, the strength of the magnet 70 may be reduced without significantly affecting the sensor performance. Finally, we have found that in certain mechanizations, there can be a compressor speed dependent variation in the relationship between the indicated and actual stroke. If this is the case, the controller 48 or stroke sensing circuit 54 can easily compensate for the non-linearity through the use of a look-up table or other well known technique. FIG. 3 is a block diagram of the stroke sensing circuit 54. The sensor output on line 37 is supplied as an input to a band-pass filter and gain circuit 80 which passes and amplifies those portions of the sensor output signal in a specified frequency range, such as 8 Hz to 200 Hz. The result in a clean quasi-sinusoidal signal having a frequency proportional to compressor speed CS and a peak amplitude proportional to compressor stroke. If desired, a squaring circuit 82 may be used to produce a corresponding square wave output on line 84, the period of the square wave being inversely proportional to the compressor speed. To obtain the stroke information, the output of circuit 80 is supplied as input to peak detector circuit 86, which in turn, supplies an input to sample-and-hold circuit 88. A 5 Hz clock generator 90 produces a clocking signal on line 92 that periodically resets the peak detector circuit 86 and signals the sample-and-hold circuit 88 to hold the detected peak amplitude, thereby updating the stroke indication on line 56. Thus, the peak detector circuit 86 operates to measure the peak amplitude of the filtered and amplified sensor signal over a predefined period, and the sample-and-hold circuit 88 updates the stroke indication at the end of each such period.

In summary, the present invention provides an improved compressor stroke sensing apparatus that is both less expensive and more reliable and accurate than known devices. While the invention has been described in reference to the illustrated embodiment, it is expected that various modifications in addition to those suggested above will occur to those skilled in the art. In this regard, it will be understood that the scope of this invention is not limited to the illustrated embodiment, and that sensors and circuits incorporating such modifications may fall within the scope of this invention, which is defined by the appended claims.

What is claimed is:

1. A variable stroke refrigerant compressor including a non-magnetic housing, a non-rotary plate tiltable to determine a stroke of said compressor, said non-rotary plate being supported within said housing and having a peripheral ferrous element that is constrained to reciprocating movement in proximity to said housing, the compressor further comprising:

a sensor module including a magnetic field responsive sensor mounted on an exterior surface of said housing so as to detect a magnetic flux passing through said ferrous element and said housing, the sensor producing a quasi-sinusoidal voltage corresponding to the reciprocating movement of said ferrous element; and a stroke sensing circuit for filtering and amplifying said quasi-sinusoidal voltage, and for detecting peak values of the filtered and amplified voltage as an indication of the compressor stroke.

2. The variable stroke refrigerant compressor of claim 1, wherein said sensor module includes a permanent magnet for producing the magnetic flux passing through said ferrous element.

3. The variable stroke refrigerant compressor of claim 2, wherein said permanent magnet is disposed adjacent said sensor and in line with the reciprocating movement of said ferrous element.

4. The variable stroke refrigerant compressor of claim 1, wherein the stroke sensing circuit includes a band-pass filter for filtering said quasi-sinusoidal voltage.

5. The variable stroke refrigerant compressor of claim 1, wherein the stroke sensing circuit includes a peak detector circuit for detecting peak values of the filtered and amplified voltage, and a sample-and-hold circuit periodically triggered to hold an output of said peak detector circuit as an indication of the compressor stroke.

6. The variable stroke refrigerant compressor of claim 5, wherein the peak detector circuit is reset in synchronism with the triggering of said sample-and-hold circuit.

7. The variable stroke refrigerant compressor of claim 1, wherein the stroke sensing circuit further includes a circuit responsive to the filtered and amplified voltage for producing a square-wave signal having a period that is inversely proportional to a rotary speed of said compressor.

8. The variable stroke refrigerant compressor of claim 1, wherein the compressor includes an electromagnetic clutch, and a magnetic field of the clutch produces the magnetic flux passing through said ferrous element.

* * * * *